US007040096B2

(12) United States Patent
Manteiga et al.

(10) Patent No.: US 7,040,096 B2
(45) Date of Patent: May 9, 2006

(54) METHODS AND APPARATUS FOR SUPPLYING FEED AIR TO TURBINE COMBUSTORS

(75) Inventors: John A. Manteiga, North Andover, MA (US); Walter J. Tingle, Danvers, MA (US); Timothy A. White, Peabody, MA (US); Kevin F. Canillas, Everett, MA (US)

(73) Assignee: General Electric Company, Schenectady, NY (US)

( * ) Notice: Subject to any disclaimer, the term of this patent is extended or adjusted under 35 U.S.C. 154(b) by 241 days.

(21) Appl. No.: 10/657,312

(22) Filed: Sep. 8, 2003

(65) Prior Publication Data

US 2005/0050903 A1 Mar. 10, 2005

(51) Int. Cl.
*F23R 3/42* (2006.01)

(52) U.S. Cl. ..... 60/722; 60/752

(58) Field of Classification Search ..... 60/39, 60/511, 722, 751, 752, 804
See application file for complete search history.

(56) References Cited

U.S. PATENT DOCUMENTS 2,967,224 A * 1/1961 Irwin ..... 361/266
4,686,823 A 8/1987 Coburn et al.
4,950,129 A 8/1990 Patel et al.
5,222,360 A 6/1993 Antuna et al.
5,228,828 A 7/1993 Damlis et al.
5,273,396 A 12/1993 Albrecht et al.
5,281,085 A 1/1994 Lenahan et al.
5,297,385 A 3/1994 Dubell et al.
5,820,024 A 10/1998 Ausdenmoore et al.
5,911,679 A 6/1999 Farrell et al.
6,045,325 A 4/2000 Horvath et al.
6,860,098 B1 * 3/2005 Suenaga et al. ..... 60/752

* cited by examiner

*Primary Examiner*—Louis J. Casaregola
(74) *Attorney, Agent, or Firm*—William Scott Andes; Armstrong Teasdale LLP

(57) ABSTRACT

A method enables a gas turbine engine to be assembled. The method includes providing a combustor including a liner that defines a combustion chamber therein, and coupling a casing within the gas turbine engine to extend circumferentially around the combustor liner, wherein the casing includes an inlet and a scroll duct that is coupled in flow communication to the inlet and extends at least partially circumferentially around the liner. The method also includes coupling the inlet in flow communication with a feed air source.

17 Claims, 4 Drawing Sheets

METHODS AND APPARATUS FOR SUPPLYING FEED AIR TO TURBINE COMBUSTORS

STATEMENT REGARDING FEDERALLY SPONSORED RESEARCH OR DEVELOPMENT

The U.S. Government may have certain rights in this invention pursuant to contract number DAAE07-00-C-N086.

BACKGROUND OF THE INVENTION

This invention relates generally to gas turbine engines, more particularly to methods and apparatus for supplying feed air to turbine combustors.

Known turbine engines include a compressor for compressing air which is suitably mixed with a fuel and channeled to an annular combustor wherein the mixture is ignited for generating hot combustion gases. The gases are channeled to at least one turbine, which extracts energy from the combustion gases for powering the compressor, as well as for producing useful work, such as propelling a vehicle.

In at least some known turbine engines, compressor discharge air is preheated in a separate heat exchanger before being routed to the combustor via a duct. More specifically, the feed air is routed through to the combustor through a single feed point inlet. Although all of the air entering the inlet is channeled to the combustor, because the feed air may not be supplied uniformly to the annular combustor, unnecessary pressure losses and mal-distribution of supply air to the combustor. As a result, engine performance may be reduced and circumferential temperature gradients may be induced around the casing surrounding the combustor. Over time, such gradients may cause non-circumferential thermal growth which may adversely impact turbomachinery blade tip clearances and/or reduce engine performance. Furthermore, continued operation with such thermal gradients may reduce the useful life of the combustor.

BRIEF DESCRIPTION OF THE INVENTION

In one aspect, a method for assembling a gas turbine engine is provided. The method comprises providing a combustor including a liner that defines a combustion chamber therein, and coupling a casing within the gas turbine engine to extend circumferentially around the combustor liner, wherein the casing includes an inlet and a scroll duct that is coupled in flow communication to the inlet and extends at least partially circumferentially around the liner. The method also comprises coupling the inlet in flow communication with a feed air source.

In a further aspect of the invention, a combustor for a gas turbine engine is provided. The combustor includes a liner that defines a combustion chamber therein, and a casing that extends circumferentially around the combustor liner. The casing includes an inlet coupled in flow communication with a feed air source, and a scroll duct coupled in flow communication with the inlet. The scroll duct extends at least partially circumferentially around the liner.

In another aspect, a gas turbine engine is provided. The gas turbine engine includes a compressor, and a combustor upstream from the compressor. The combustor includes a liner that defines a combustion chamber therein, and a casing that extends circumferentially around the combustor liner. The casing includes an inlet coupled in flow communication with the compressor, and a scroll duct that is coupled in flow communication with the inlet and extends at least partially circumferentially around the liner.

DETAILED DESCRIPTION OF THE INVENTION

Figure 1:
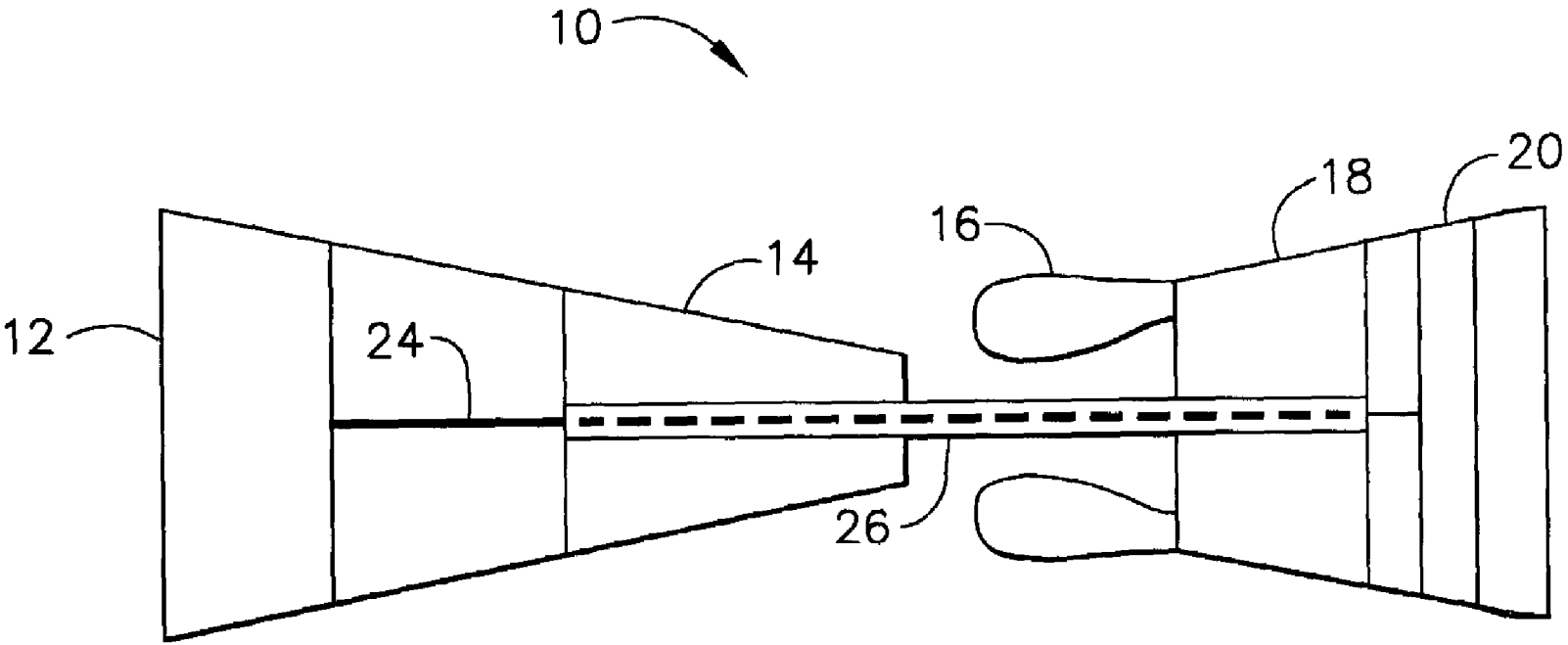
FIG. 1 is a schematic of a gas turbine engine.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20. Compressor 12 and turbine 20 are coupled by a first shaft 24, and compressor 14 and turbine 18 are coupled by a second shaft 26. In one embodiment, the gas turbine engine is an LV100 available from General Electric Company, Cincinnati, Ohio. In the exemplary embodiment, gas turbine engine 10 is a recouperated engine.

In operation, air flows through low pressure compressor 12 and compressed air is supplied from low pressure compressor 12 to high pressure compressor 14. The highly compressed air is delivered to combustor 16. Airflow from combustor 16 drives turbines 18 and 20 before exiting gas turbine engine 10.

Figure 2:
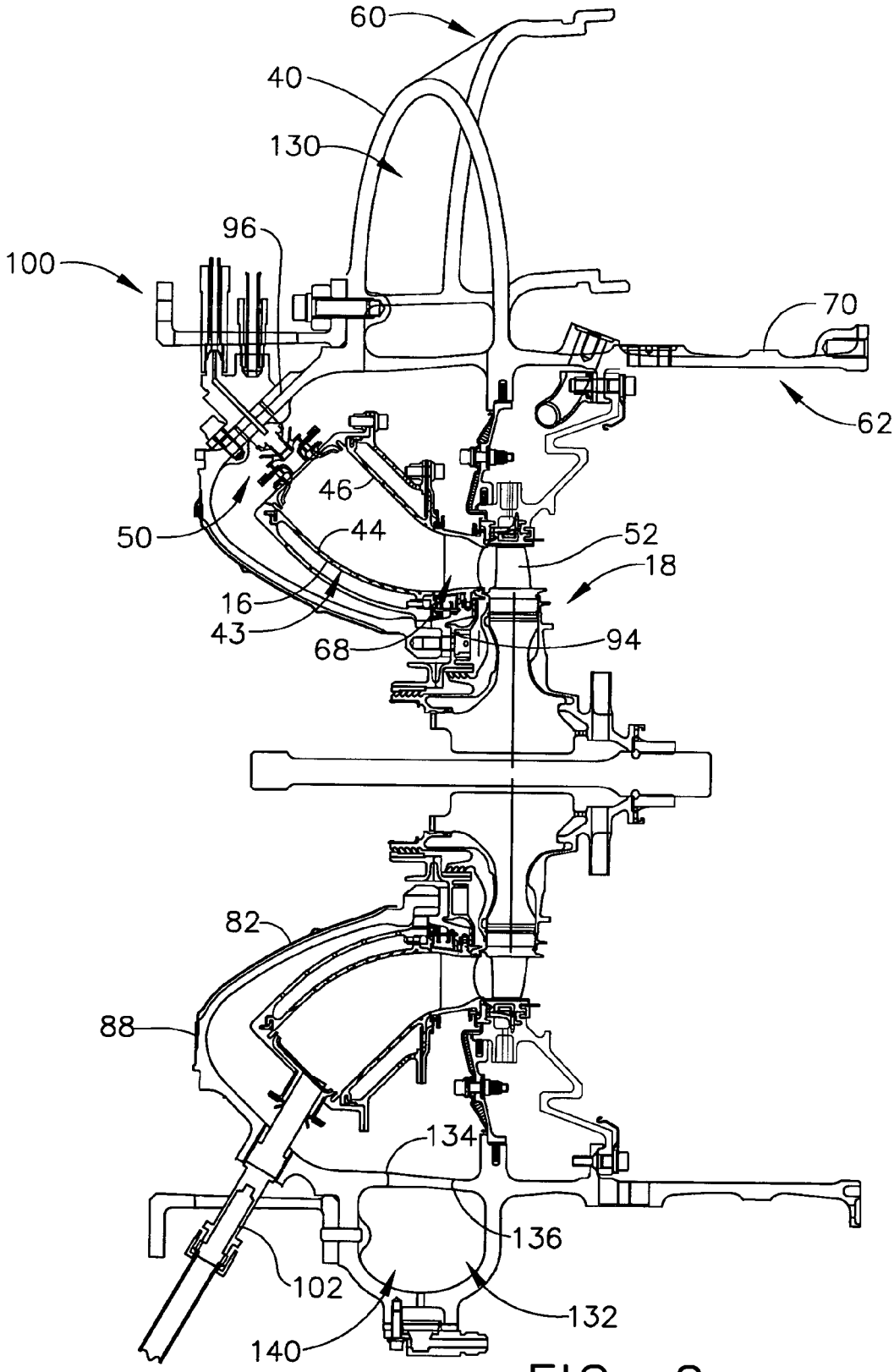
FIG. 2 is a cross-sectional illustration of a portion of the gas turbine engine shown in FIG. 1.
Figure 3:
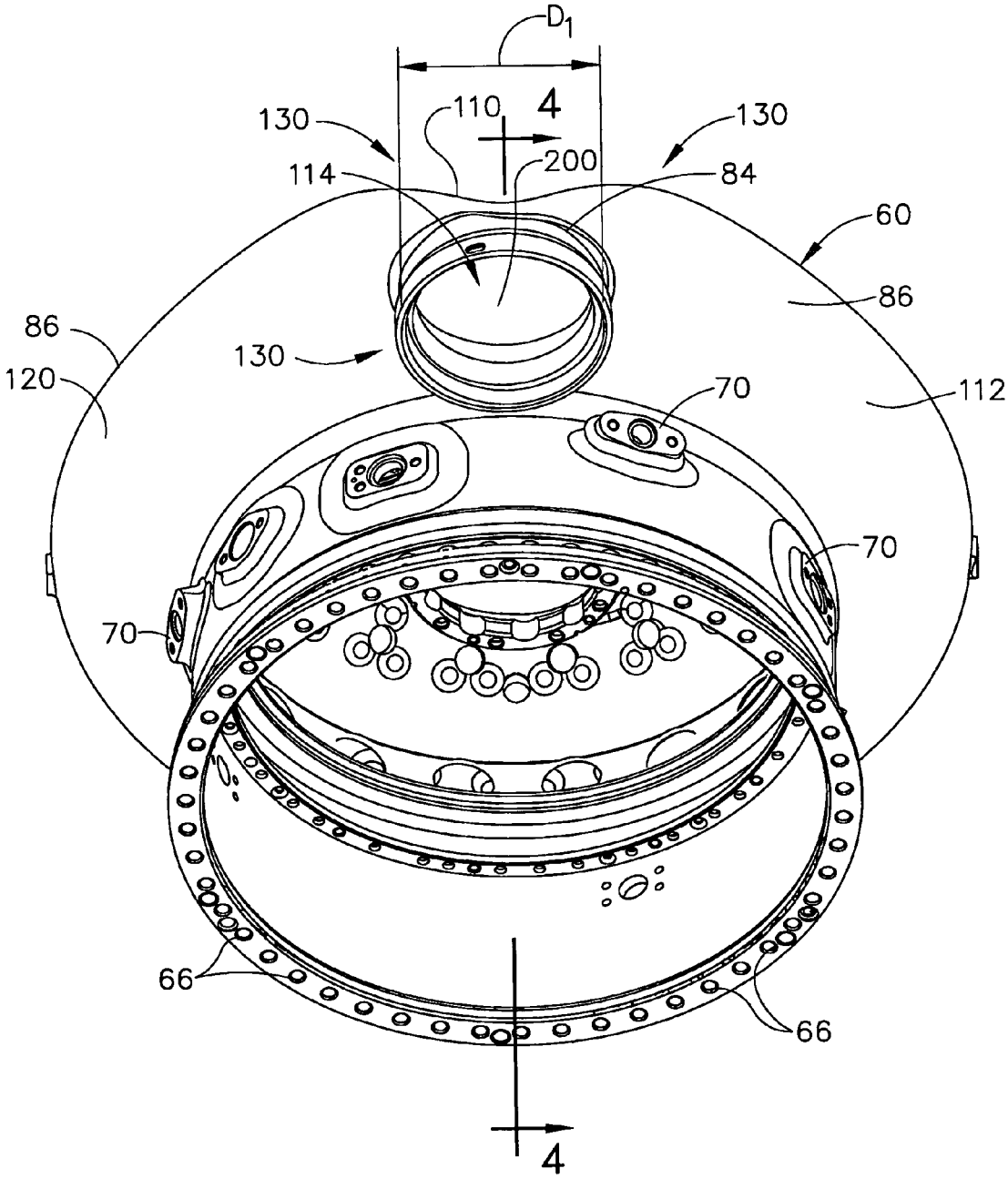
FIG. 3 is a perspective view of a combustor casing shown in FIG. 2 and viewed from downstream.
Figure 4:
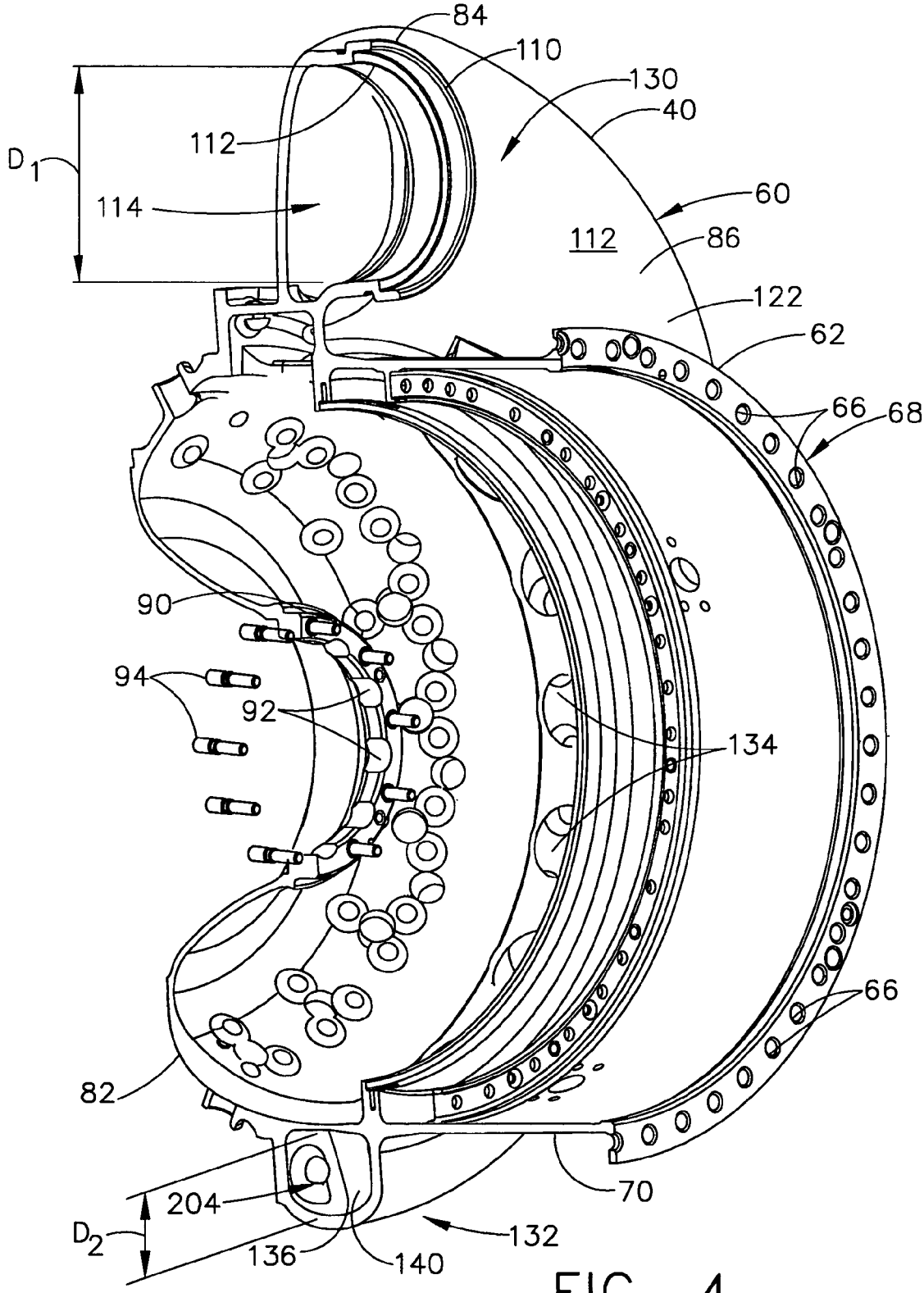
FIG. 4 is a partial perspective view of the combustor casing shown in FIG. 3 and taken along line 4—4.

FIG. 2 is a cross-sectional illustration of a portion of gas turbine engine 10 including combustor 16 and turbine 18. FIG. 3 is a perspective view of a combustor casing 40 that extends circumferentially around combustor 16. FIG. 4 is a partial perspective view of combustor casing 40 taken along line 4—4 shown in FIG. 3. Combustor 16 is annular includes a liner assembly 43 that includes an inner liner 44 and an outer liner 46 that each extend downstream from an upstream end 50 of combustor 16 to a turbine nozzle assembly 52. Inner liner 44 is spaced radially inwardly from outer liner 46 such that a combustion chamber 54 is defined therebetween. Combustor 16 is positioned radially inwardly from combustor casing 40.

Combustor casing 40 is annular and extends circumferentially around combustor 16. Casing 40 includes an air delivery portion 60 and a mounting portion 62 that extends downstream from air delivery portion 60. In the exemplary embodiment, air delivery portion 60 is formed integrally with mounting portion 62. Mounting portion 62 is substantially cylindrical and extends downstream from air delivery portion 60 to a mounting flange 64. Flange 64 is annular and includes a plurality of circumferentially-spaced openings 66 that are sized to receive a plurality of fasteners (not shown) therethrough for securing a downstream end 68 of casing 40 within gas turbine engine 10. Mounting portion 62 also includes a plurality of openings 70 extending therethrough between casing portion 60 and flange 64. Openings 70 are each sized to receive a fastener 74 therethrough for securing engine components, such as a turbine frame 76, to casing 40. Openings 70 also enable engine services to extend through casing 40.

Casing air delivery portion 60 includes an annular shield portion 82, a recouperator air inlet 84, and a scroll duct 86 extending therebetween. Annular shield portion 82 defines a bluff upstream end 88 of casing 40 and includes a mounting flange 90 that is radially inward of, and downstream from, upstream end 88. Mounting flange 90 includes a plurality of circumferentially-spaced openings 92 that are each sized to receive a fastener 94 therethrough for securing casing upstream end 88 within gas turbine engine 10. Shield portion 82 also includes a plurality of openings 96 that extend therethrough between upstream end 88 and scroll duct 86. Openings 96 permit passage of engine components and/or engine services 100 therethrough. For example, in the exemplary embodiment, a plurality of fuel injectors 102 extend through openings 96.

Air inlet 84 is positioned circumferentially at approximately a one-o'clock position when viewed from upstream. Air inlet 84 includes a substantially cylindrical duct portion 110 that extends downstream from a downstream surface 112 of scroll duct 86. Air inlet 84 is coupled by duct portion 110 in flow communication to a discharge from compressor 14 (shown in FIG. 1). Air inlet duct portion 110 has an inner diameter $D_1$ measured with respect to an inner surface 112 of duct portion 110.

Scroll duct 86 is hollow and extends in flow communication from air inlet 84 such that all fluid flow discharged from inlet 84 enters scroll duct 86. According, immediately adjacent inlet 84, scroll duct 86 has an inlet cross-sectional area 114 that is defined with an inner diameter $D_1$. In the exemplary embodiment, scroll duct 86 includes a left-hand scroll arm 120 and a right-hand scroll arm 122 that is a mirror image of arm 120. Arms 120 and 122 are each arcuate and extend approximately 180° from inlet 84. In an alternative embodiment, scroll duct 86 includes only one arm 120 or 122 that extends slightly less than 360° from inlet 84 such that the arm facilitates distributing fluid flow as described in more detail below.

Each scroll duct arm 120 and 122 has an inlet end 130 that is adjacent inlet 84 and a discharge end 132 that is opposite inlet end 130 and is approximately offset 180° from inlet 84. Scroll duct arms 120 and 122 are coupled together in flow communication, and each arm 120 and 122 includes a plurality of openings 134 that extend therethrough. More specifically, openings 134 are formed only along an inner diameter of scroll duct arms 120 and 122 and thus, extend only through a radially inner surface 136 of each scroll duct arm 120 and 122, and are thus, in flow communication with a fluid passageway 140 defined within scroll duct 84.

In the exemplary embodiment, a splitter 200 is positioned between air inlet 84 and scroll duct 86. In an alternative embodiment, casing 40 does not include splitter 200. Splitter 200 is contoured to channel fluid flow discharged from air inlet 84. More specifically, in the exemplary embodiment, splitter 200 is formed integrally with casing 40 and channels a portion of fluid flow discharged from inlet 84 into arm 120, and the remaining fluid flow into arm 122. In the exemplary embodiment, splitter 200 channels approximately 50% of the total discharged fluid flow into each arm 120 and 122. Accordingly, approximately 50% of the fluid flowing through scroll duct 86 flows in a clockwise direction, and approximately 50% of the fluid flowing through scroll duct 86 flows in a counter-clockwise direction.

Each scroll duct arm 120 and 122 has a variable cross-sectional profile extending between each respective inlet end 130 and discharge end 132. Scroll duct 86 has an inner diameter $D_2$ at discharge end 132 that is smaller than inlet inner diameter $D_1$. More specifically, scroll duct 86 has a variable cross-sectional area that diminishes from scroll duct inlet end 130 to duct discharge end 132. Accordingly, a discharge cross-sectional area 204 defined by inner diameter $D_2$ is smaller than inlet cross-sectional area 87.

During operation, a portion of pressurized air discharged from compressor 14 is routed to combustor 16 for use as feed air. Specifically, the air is eventually channeled to combustor casing air delivery portion 60 through recuperator air inlet 84. More specifically, in the exemplary embodiment, air discharged from inlet 84 contacts splitter 200 and approximately 50% of the fluid flow exiting inlet 84 is directed clockwise into scroll duct arm 122 and the remaining fluid flow is directed counter-clockwise into scroll duct arm 120. Air flowing through scroll duct 86 is directed radially inwardly through duct openings 134 towards combustor liner assembly 43. The combination of the decreasing cross-sectional flow area defined within scroll duct 86, and the circumferential-spacing and size of openings 134 facilitates providing a substantially uniform flow towards combustor liner assembly 43. More specifically, because openings 134 extend between scroll duct inlet and discharge ends 130 and 132, respectively, openings 134 provide circumferential flow towards liner assembly 43.

In the exemplary embodiment, as a result of the decreasing cross-sectional flow area defined within scroll duct 86 and openings 134 all feed air flowing through scroll duct 86 is exhausted after traveling approximately 180° from inlet 84. Because the feed air is supplied substantially uniformly around combustor liner assembly 43, thermal gradients induced within liner assembly 43 and thermal growth distortion of liner assembly 43 is facilitated to be reduced. Furthermore, scroll duct 86 also facilitates improving combustion pattern factor, which results in improved combustor performance and/or extending a useful life of combustor 16. In addition, because thermal growth distortion of liner assembly 43 is facilitated to be reduced, scroll duct 86 also enhances turbomachinery blade tip clearance control.

The above-described combustor casing provides a cost-effective and reliable means for reducing thermal gradients induced withinthe combustor liner. More specifically, the casing directs feed air substantially uniformly and circumferentially towards the combustor liner. As a result, thermal growth distortion of the liner is facilitated to be reduced. Moreover, the combustor casing facilitates extending a useful life of the combustor in a cost-effective and reliable manner.

An exemplary embodiment of a combustor casing is described above in detail. The casing illustrated is not limited to the specific embodiments described herein, but rather, components of each may be utilized independently and separately from other components described herein.

While the invention has been described in terms of various specific embodiments, those skilled in the art will recognize that the invention can be practiced with modification within the spirit and scope of the claims.

What is claimed is:

1. A method for assembling a gas turbine engine, said method comprising:

providing a combustor including a liner that defines a combustion chamber therein;

coupling a casing within the gas turbine engine to extend circumferentially around the combustor liner, wherein the casing includes an inlet and a scroll duct that is coupled in flow communication to the inlet and extends at least partially circumferentially around the liner;

coupling the inlet in flow communication with a feed air source; and forming a plurality of openings extending through the combustor scroll duct for directing feed air circumferentially around the combustor liner to facilitate reducing thermal gradients induced within the liner.

2. A method in accordance with claim 1 wherein coupling a casing within the gas turbine engine further comprises coupling a casing within the gas turbine engine that includes a splitter positioned between the inlet and the scroll duct, such that a portion of feed air discharged from the inlet is directed into a clockwise fluid flow direction and such that the remaining fluid is directed in a counter-clockwise fluid flow direction.

3. A method in accordance with claim 1 wherein coupling a casing within the gas turbine engine further comprises coupling a casing within the gas turbine engine such that the scroll duct has a first cross-sectional area at an inlet end, and a second cross-sectional area at a discharge end that is opposite the inlet end, wherein the first cross-sectional area is larger than second cross-sectional area.

4. A method in accordance with claim 1 wherein coupling a casing within the gas turbine engine further comprises coupling a casing within the gas turbine engine such that the scroll duct has an inlet end, a discharge end, and a variable cross-sectional area extending therebetween.

5. A combustor for a gas turbine engine, said combustor comprising:

a liner defining a combustion chamber therein; and a casing extending circumferentially around said combustor liner, said casing comprising an inlet coupled in flow communication with a feed air source and a scroll duct coupled in flow communication with said inlet and extending at least partially circumferentially around said liner, said scroll duct comprising a first arcuate portion extending from said inlet and a second arcuate portion extending from said inlet, said first arcuate portion is a substantial mirror image of said second arcuate portion, wherein each of said first and second arcuate portions comprises a variable cross-sectional area.

6. A combustor in accordance with claim 5 wherein said scroll duct comprises a plurality of openings formed therein, said openings for directing feed air substantially uniformly around said combustor liner.

7. A combustor in accordance with claim 6 wherein said plurality of openings are spaced substantially circumferentially through said scroll duct around said combustor liner.

8. A combustor in accordance with claim 5 further comprising a splitter positioned between said scroll duct and said inlet for channeling a portion of feed air discharged from said inlet in a clockwise flow direction through said first arcuate portion, and for channeling the remaining feed air discharged from said inlet in a counter-clockwise flow direction through said second arcuate portion.

9. A combustor in accordance with claim 5 wherein said scroll duct has a variable cross-sectional area extending along a length of said scroll duct.

10. A combustor in accordance with claim 5 wherein said scroll duct has a first cross-sectional area adjacent said inlet and a second cross-sectional area opposite said inlet, said scroll duct second cross-sectional area smaller than said scroll duct first cross-sectional area.

11. A combustor in accordance with claim 5 wherein said scroll duct configured to facilitate reducing circumferential thermal gradients within said combustor liner.

12. A gas turbine engine comprising:

a compressor; and a combustor downstream from said compressor, said combustor comprising a liner defining a combustion chamber therein, and a casing extending circumferentially around said combustor liner, said casing comprising an inlet coupled in flow communication with said compressor, and a scroll duct coupled in flow communication with said inlet and extending at least partially circumferentially around said liner, wherein said scroll duct comprises a plurality of openings extending therethrough, said openings for channeling feed air around said combustor liner.

13. A gas turbine engine in accordance with claim 12 wherein said combustor scroll duct plurality of openings are spaced circumferentially around said combustor liner to facilitate reducing circumferential thermal gradients induced within said liner.

14. A gas turbine engine in accordance with claim 12 wherein said combustor further comprises a splitter extending between said inlet and said scroll duct, said splitter for inducing a clockwise fluid flow into a portion of feed air discharged from said inlet, and inducing a counter-clockwise fluid flow into the remaining feed air discharged from said inlet.

15. A gas turbine engine in accordance with claim 12 wherein said combustor scroll duct comprises a first duct for channeling fluid flow in a clockwise direction from said inlet, and a second duct for channeling fluid flow in a counter-clockwise direction from said inlet.

16. A gas turbine engine in accordance with claim 12 wherein said combustor scroll duct has a first cross-sectional area at an inlet end adjacent said inlet, and a second cross-sectional area at a discharge end opposite said inlet, wherein the first cross-sectional area is larger thansecond cross-sectional area.

17. A gas turbine engine in accordance with claim 12 wherein said combustor scroll duct has an inlet end, a discharge end, and a variable cross-sectional area therebetween.

* * * * *